US005314260A

United States Patent [19]

Andersson

[11] Patent Number: 5,314,260

[45] Date of Patent: May 24, 1994

[54] FINGER PEN

[76] Inventor: Jan Andersson, Alsikegatan 2, S-753 23 Uppsala, Sweden

[21] Appl. No.: 11,100

[22] Filed: Jan. 29, 1993

Related U.S. Application Data

[63] Continuation-in-part of Ser. No. 761,347, Sep. 11, 1991, abandoned.

[30] Foreign Application Priority Data

Mar. 22, 1989 [SE] Sweden ..... 89 01012-8

[51] Int. Cl.[5] ..... B43K 7/00; B43K 8/00

[52] U.S. Cl. ..... 401/7; 15/443; 401/8

[58] Field of Search ..... 401/7, 8; 15/443

[56] References Cited

U.S. PATENT DOCUMENTS

| | | | |
|---|---|---|---|
| 500,564 | 7/1893 | Dierlamm | 15/443 |
| 1,304,171 | 5/1919 | Ferree | 15/443 |
| 2,292,324 | 8/1942 | Lawrence | 401/8 |
| 3,505,700 | 4/1970 | Rodriguez | 401/8 X |
| 3,887,286 | 6/1975 | Bucey | 401/7 |
| 4,127,338 | 11/1978 | Laybourne | 401/8 |
| 4,846,710 | 7/1989 | Campbell | 401/8 X |

FOREIGN PATENT DOCUMENTS

| | | | |
|---|---|---|---|
| 2461387 | 7/1976 | Fed. Rep. of Germany . | |
| 1078785 | 11/1954 | France | 401/8 |
| 1264621 | 5/1961 | France | 401/7 |
| 2492738 | 4/1982 | France . | |
| 2523514 | 9/1983 | France | 401/7 |
| 2636886 | 3/1990 | France | 401/7 |
| 665 | 2/1868 | United Kingdom | 15/443 |
| 1253519 | 11/1971 | United Kingdom . | |
| 1253963 | 11/1971 | United Kingdom | 401/7 |
| 2061832 | 5/1981 | United Kingdom | 401/7 |

*Primary Examiner*—Steven A. Bratlie
*Attorney, Agent, or Firm*—Young & Thompson

[57] ABSTRACT

A finger pen is provided which may be removably attached to a finger such that the pen is held in a prone position by which is meant that the pen is held in place with the palm of the hand turned downward facing the surface which is to be written upon.

2 Claims, 2 Drawing Sheets

FINGER PEN

This application is a continuation of application Ser. No. 07/761,347, filed Sep. 11, 1991, now abandoned.

BACKGROUND OF THE INVENTION

The present invention relates to a finger pen which is removably attachable to a finger.

It is well known that writing and drawing pens have traditionally been designed as rod-like structures which contain graphite, ink, paste and similar substances and have tips which produce a stroke or line or the like when the tip is brought into contact with and moved along a paper or similar surface. The rod shape was the same with the predecessors of modern pens such as brushes, gas pens, steel pens, and the like. In the manufacture of early rod-shaped pens, industry had insufficient means, both technologically and in terms of material, of producing other types of pens. There is no doubt that today's state of the art enables a new approach aiming at a more efficient design. However, there is a continued emphasis upon the traditional notion that pens must be rod-shaped, in spite of the fact that such shape makes unnecessarily stringent demands on the fine-motor function of the user. We understand the problem most readily by studying the fine-motor development of a child. In particular, when considering the fine-motor function of an individual, the brain of a child is normally not sufficiently developed to allow for the so-called semi-supine holding of a traditional rod-like pen or pencil until the child is 6 to 7 years of age. By semi-supine is meant that the palm of the hand is turned to the side.

SUMMARY OF THE INVENTION

The object of the present invention is to solve the above problem in such a way that by using modern technology and materials an alternative to the traditional rod-like design of pens is provided which allows for holding the pen in a manner which subjects the user to less stringent fine-motor demands and in a manner which can be achieved at an earlier stage of fine-motor development.

The present invention relates to a finger pen and is based upon the holding of the pen in a prone position by which is meant that the pen is held with the palm of the hand turned downward as opposed to a supine position wherein the palm of the hand is turned upward. A human being with normal fine-motor development can use a pen in this manner at 2 to 3 years of age. Hence the invention provides for a generally simplified holding of a pen, the possibility of children handling a pen in a functionally correct manner at an early age, easier learning of writing and drawing by school children, and a greater possibility for adults with inadequate fine-motor function to control their pens. A secondary advantage of the finger pen of the present invention is that one obtains a much better view of one's writing, which is especially true in the case of a left-handed person. Holding of the finger pen of the present invention in a prone position works best if the pen tip projects from or in the vicinity of the sensible center of feeling of the writing/drawing finger and faces away from the latter at such an angle that the pen tip is visible to the eye of the user down to the surface at which the stroke of the finger pen is to be produced. The sensible center of feeling is that point on the writing/drawing finger which, when gripping a very small object against the thumb, balances the object in a controlled position.

BRIEF DESCRIPTION OF THE DRAWINGS

This invention may be clearly understood by reference to the attached drawings in which.

DESCRIPTION OF THE PREFERRED EMBODIMENT

Figure 1:
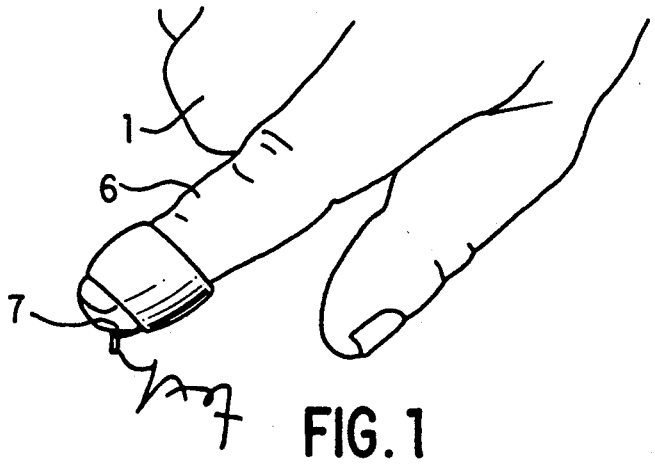
FIG. 1 is a perspective view of one embodiment of the finger pen of the present invention in use, the pen being held in a prone position.

Generally, finger pens 2, 3 and 4 each have a pen tip 5 which is towards the users finger 6. The extension of each pen tip 5 emanates from or in the vicinity of the sensible center of feeling 7 of finger 6 and is angled as shown in the attached drawings; that is, it is angled to correspond with the normal pen angle which exists when using a traditional rod-shaped pen being held in a semi-supine manner. As a result, the point at which tip 5 of the writing implement contacts the writing/drawing surface 8 will be visible to the user. If finger pens 2, 3 and 4 are not in use, a guard 9 may be placed over tip 5 of the pen. The different finger pens 2, 3 and 4 comprise a container 10 which contains paste, ink, etc. and is directly connected with tip 5 of the pen, the size of container 10 being maximized irrespective of whether finger pens 2, 3 and 4 are designed without support grip 11.

Figure 2:
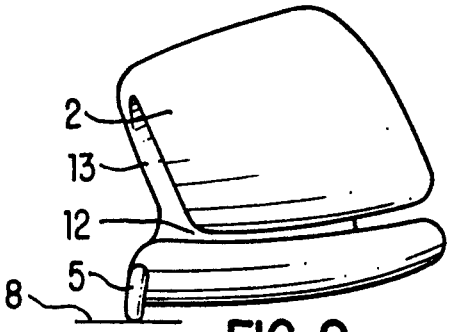
FIG. 2 is an elevational view of an open-type finger pen of the present invention.
Figure 3:
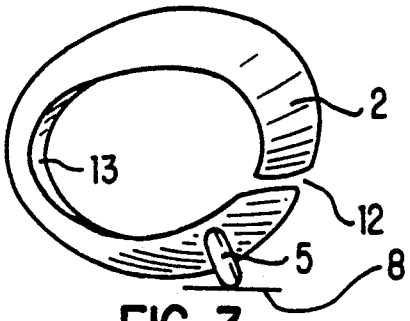
FIG. 3 is an end view of an open-type finger pen of the present invention; I
Figure 4:
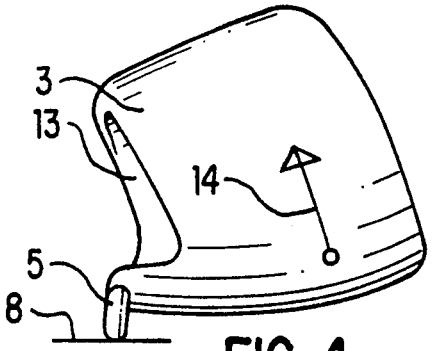
FIG. 4 is an elevational view of a closed-type finger pen of the present invention.
Figure 5:
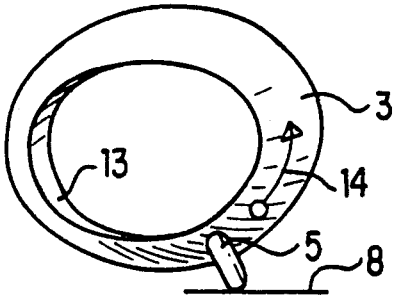
FIG. 5 is an end view of a closed-type finger pen of the present invention.
Figure 6:
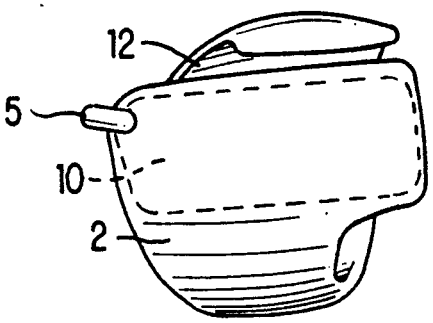
FIG. 6 is an elevational view of an open-type finger pen of the present invention.
Figure 7:
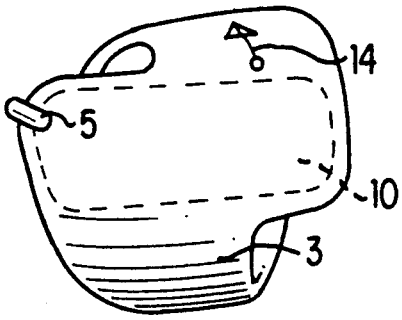
FIG. 7 is an elevational view of a closed-type finger pen of the present invent.
Figure 8:
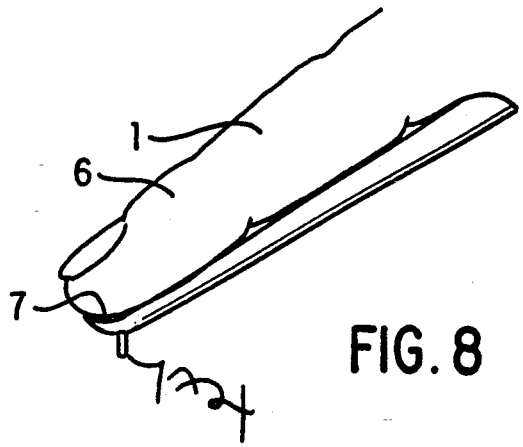
FIG. 8 is a perspective view of another embodiment of the finger pen of the present invention in use, the pen being held in a prone position.
Figure 9:
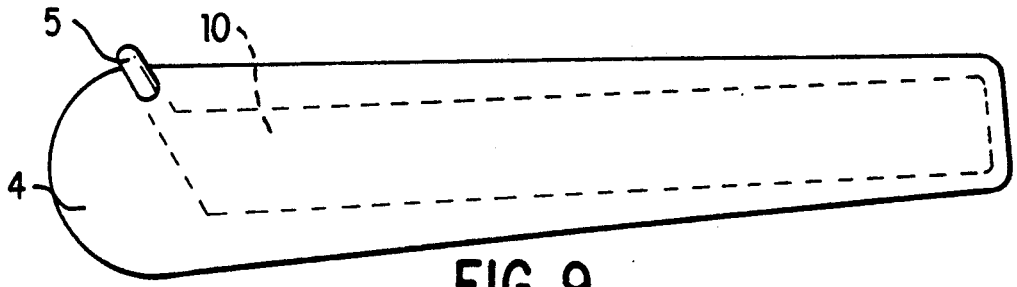
FIG. 9 is a view of a finger pen of the present invention having a contoured shape.
Figure 10:
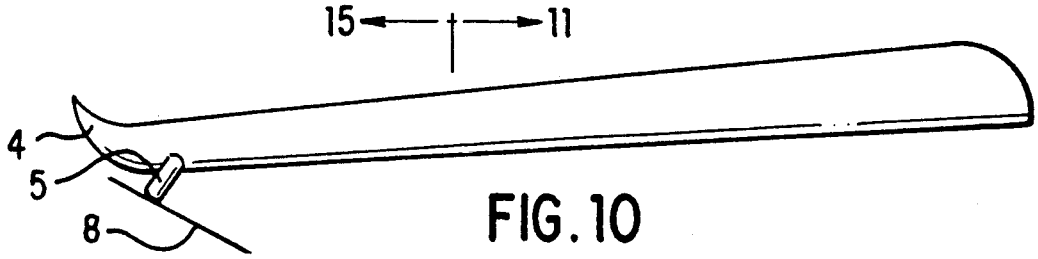
FIG. 10 is an elevational view of the finger pen of FIG. 9.
Figure 11:
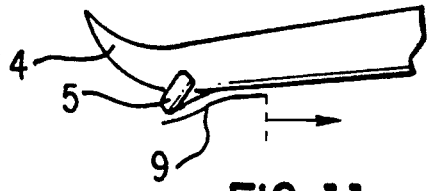
FIG. 11 is a view of a guard for the pen tip of the finger pen of the present invention.

Finger pen 2 of FIGS. 2, 3 and 6 is an open-type, the opening being designated 12, and finger pen 3 of FIGS. 4, 5 and 7 is a closed-type, no such opening being provided. In either case, the finger pen 2, 3 is designed such that inner surface 13 abuts, in an ergonomically correct manner, the user's finger 6 and is retained in place by means of the pressure and friction between inner surface 13 and the user's finger 6 brought about by the characteristics of the material and the design of finger pen 2 and 3. The closed finger pen 3 may be complemented with a clip, buckle, etc. 14.

Fingers 8, 9 and 10 show a finger pen 4 of contoured shape having a length identified by arrow 15 which provides a contact face which is made to fit the lower part of the user's finger 6. The extension of contact face 15 constitutes a support grip 11 resting against the user's finger 6, by means of which the user retains finger pen 4 relative to finger 6. Finger pen 2, 3 can also be complemented with a support grip 11 in which case the pen may be retained relative to the finger in the manner described above or with the aide of support grip 11, in which case it will be possible to dispense with the above method of retention.

I claim:

1. A finger pen comprising a sleeve removably attachable to a finger and a pen tip protruding from the sleeve at an angle and in communication with a container for supplying paste, ink or the like to the pen tip, the sleeve being resilient and adapted to be positioned upon a user's finger so that in use in a protonated orientation the pen tip will extend from said sleeve such as to project from the vicinity of a sensible center of feeling of the finger and at an angle from the sleeve corresponding to an angle of a rod-shaped pen held in a normal semi-supine manner, and the pen tip will extend from the sleeve at such a length that the pen tip will be visible to the user during use, and the sleeve being discontinuous, a split separating a lower pen tip supporting portion of said sleeve from a finger grasping portion of said sleeve.

2. A finger pen comprising a pen tip extending from a split sleeve, said split sleeve comprising a top portion, a bottom portion, a first side and an opposite second side, said pen tip extending from said bottom portion at an angle, said first side, said top portion and said opposite second side extending from one side of said bottom portion towards an opposite side of said bottom portion to form resilient means for adjustable positioning said finger pen on a finger so that when said pen is in use in a pronated orientation said pen tip will extend from said bottom portion such as to (a) project from the vicinity of a sensible center of feeling of a finger, (b) be visible to said user, and (c) extend at an angle relative to said split sleeve corresponding to an angle of a rod-shaped pen held in a normal semi-supine manner.

* * * * *